United States Patent [19]

Vind

[11] 4,251,793

[45] Feb. 17, 1981

[54] PTC RESISTOR

[75] Inventor: Holger V. Vind, Nordborg, Denmark

[73] Assignee: Danfoss A/S, Nordborg, Denmark

[21] Appl. No.: 37,526

[22] Filed: May 9, 1979

[30] Foreign Application Priority Data

May 13, 1978 [DE] Fed. Rep. of Germany ..... 2821206

[51] Int. Cl.[3] ..... H01C 7/02

[52] U.S. Cl. ..... 338/22 R; 338/25; 338/325

[58] Field of Search ..... 338/22 R, 22 SD, 23, 338/25, 325; 361/150, 165; 29/610, 612

[56] References Cited

U.S. PATENT DOCUMENTS

| | | | |
|---|---|---|---|
| 3,845,442 | 10/1974 | Ihaya et al. | 338/23 |
| 4,031,499 | 6/1977 | Brueckner | 338/23 |

*Primary Examiner*—C. L. Albritton

*Attorney, Agent, or Firm*—Wayne B. Easton

[57] ABSTRACT

The invention relates to a resistor of the type having a resistance which varies with temperature such as PTC and NTC resistors. The resistor is characterized by having three or more connector pads and several different arrangements for the connector pads.

7 Claims, 12 Drawing Figures

PTC RESISTOR

The invention relates to a PTC resistor with a resistor body comprising a substantially homogeneous cold conductor material bonded to connections.

Such PTC resistors can be made by sintering barium titanate to which suitable metal oxides and salts are added. During sintering, mixed crystals are formed and the barium titanate becomes a semi-conductor. The resistor body is often made in disc form and provided with two connections in the form of soldered-on wires.

If one wishes to use such PTC resistors in multi-phase systems, whether for monitoring temperatures, limiting currents or for heating purposes, then one requires a number of PTC resistors corresponding to the number of phases if each phase of the multi-phase system is to be monitored or utilized.

The invention is based on the problem of widening the field of application of a PTC resistor of the aforementioned kind.

According to the invention, this problem is solved in that the resistor body is bonded to more than two connections.

Such a PTC resistor can also be employed in a multi-phase system, it only being necessary to connect each connection to one phase. This has the advantage that, in comparison with using separate PTC resistors for each phase, one not only dispenses with connecting a corresponding number of lead wires but also the production or selection of PTC resistors which are as alike as possible for all phases in order to avoid asymmetry. A PTC resistor that is common to all the phases automatically ensures symmetrical loading because the resistance paths of the PTC resistor between the individual phases or connections are in direct thermal contact so that temperature compensation and thus resistance compensation are ensured. In addition, this PTC resistor can however also be operated as a two-terminal network if all bar two connections are left free or two or more connections are connected directly. The selective direct connecting of individual connections and/or leaving them free can in addition result in different temperature-resistance curves with one and the same PTC resistor.

Preferably, it is ensured that predetermined bonding positions of more than two in number have substantially equal spacings from their nearest bonding positions of this number. In this construction one already obtains to start with substantial symmetry of the resistance distribution between the bonding positions of the connections, which is of advantage for applications requiring symmetric loading to start with.

In the case of a PTC resistor with a rotationally symmetrical resistor body, it is also favourable if the predetermined bonding positions have substantially equal spacings from the mid-point of the resistor body. This leads to still further resistance symmetry, also between the mid-point of the resistor body and the predetermined bonding positions. If the number of the connections (and thus the number of bonding positions) is three, then in the case of feeding the PTC resistor from a symmetrical three-phase mains the sum of the currents in the axis of symmetry of the resistor body is zero. It can therefore preferably be arranged at the star point of a three-phase system without zero conductor.

When constructing the PTC resistor with a resistor body in the form of a rotationally symmetrical disc, at least three connections may be provided at one end face or at the periphery of the disc. Whereas a plurality of connections at the end face can be bonded over a large area so that the current density is practically uniformly distributed over the resistance body, the application of the connections at the peripheral edge of the disc necessarily ensures equal spacings of the connections from the mid-point of the disc.

Next, the resistor body may be bonded to a further connection at a position having substantially the same spacing from all the other bonding positions. This connection can, if desired, be connected to the zero conductor of a multi-phase system.

The further connection can further be applied to the other end face of the disc. A current possibly flows from the other connections to this further connection with a component parallel to the axis of symmetry of the resistor body so that a comparatively long current path is produced which ensures more uniform heating of the resistor material. This can be increased still further in that the further connection contacts the entire other end face of the disc.

Instead, the further connection can also contact the side wall of a central aperture of the disc. This is particularly favourable in conjunction with the application of the other connections to the peripheral edge of the disc, to ensure symmetrical current distribution and thus uniform heating within the resistor body.

An advantageous application of the PTC resistor according to the invention is its arrangement at the star point of a multi-phase load to monitor the temperature of the load and/or the current in its individual phases by means of a single component. If the PTC resistor is in thermal contact with the load and there is an increase in temperature, the PTC resistor ensures throttling of the load current and thus limiting of the temperature. At this position, the PTC resistor can, however, also serve only for limiting the load current because on a rise in the load current the temperature and thus the resistance of the PTC resistor will also increase so that the current is reduced again.

Another favourable use of the PTC resistor is its arrangement at a multi-phase voltage source. In this case it functions as a heating element which automatically keeps its temperature constant irrespective of a change in one or more phase voltages of the mains.

Another favourable use of the PTC resistor is its arrangement parallel to a multi-phase electric motor which is connectible to multiphase mains by way of starting series resistors. In this arrangement, after the mains voltage has been switched on the PTC resistor in conjunction with the starting series resistors acts in the same way as a multi-phase voltage divider which ensures a uniform rise in the operating voltage of the motor with respect to time in all the phases so that the starting current of the motor is limited. In conjunction with a reversing switch which applies the motor to the full mains voltage after starting, it being possible to actuate this switch at the same time with a star-delta starting switch which switches the windings of the motor over for starting on the star connection and thereafter to the delta connection, the voltages in the individual phase windings of the motor can be changed within wide limits during starting.

Preferred examples of embodiments and applications of the PTC resistor according to the invention will now be described in more detail with reference to diagrammatic drawings in which.

Figure 1:
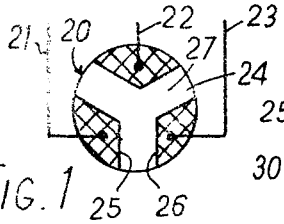
FIG. 1 is a plan view of a first example of a PTC resistor according to the invention.
Figure 2:
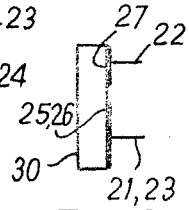
FIG. 2 is a side elevation of the FIG. 1 PTC resistor.
Figure 3:
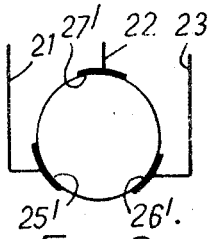
FIG. 3 is a plan view of a second example of a PTC resistor according to the invention.
Figure 4:
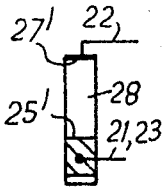
FIG. 4 is a side elevation of the PTC resistor according to FIG. 3.

According to FIGS. 1 and 2, the PTC resistor has a solid resistor body 20 in the form of a circular disc and three connections 21, 22 and 23. The resistor body 20 consists of a substantially homogeneous cold conductor material and has the connections 21 to 23 bonded to one end face 24 at positions 25, 26 and 27 which are substantially equispaced from the mid-point of the resistor body 20 and from the nearest bonding positions 25 to 27. The bonding positions 25 to 27 have a comparatively large area, are arranged axially symmetrically and are bonded to contact material which may be the same material as that of the connections. The junction between the bonding material and the connections can be produced by soldering. However, it is also possible to solder the connections direct to the resistor body or to employ the contact material as a connection. In the example of FIGS. 3 and 4, the bonding positions 25' to 27' of the connections 21 to 23 are equispaced at the peripheral edge 28 of the disc 20.

Figure 5:
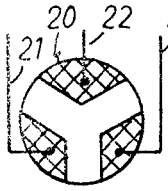
FIG. 5 is a plan view of a third example of a PTC resistor according to the invention.
Figure 6:
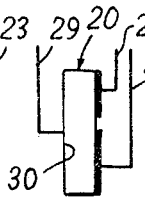
FIG. 6 is a side elevation of the FIG. 5 PTC resistor.
Figure 7:
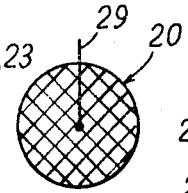
FIG. 7 is a rear elevation of the PTC resistor of FIG. 5.

The example of FIGS. 5, 6 and 7 differs from that of FIGS. 1 and 2 only in that a further connection 29 is provided at the other end face 30, the bonding position being formed by the entire end face 30.

Figure 8:
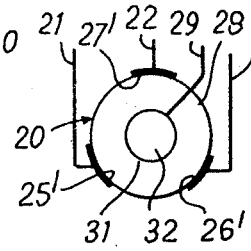
FIG. 8 is a plan view of a fourth example of a PTC resistor according to the invention.
Figure 9:
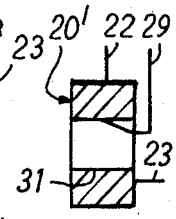
FIG. 9 is a sectional view of the FIG. 8 PTC resistor.

The example of FIGS. 8 and 9 differs from that of FIGS. 3 and 4 only in that a further connection 29 is provided at the side wall 31 of a circular cylindrical aperture 32 in the disc 20', the bonding position being formed by the entire side wall 31.

The equivalent electric circuit of the PTC resistor according to FIGS. 1 to 9 can, if all connections 21 to 23 are utilized, be represented as a delta or star circuit. It is therefore suitable for the most varied applications in which its resistance is to be dependent on the temperature, depending on whether two or more connections are occupied and depending on how many connections are provided altogether. Thus, in the example of FIGS. 1 to 4, two or three connections may be occupied, it being possible to connect two of these connections directly if all three connections 21 to 23 are occupied, so that, when using a single-phase system and occupying, say, only the connections 21 and 22, one obtains a PTC resistor with a different characteristic curve than when occupying the connection 21 and interconnecting the connections 22 and 23 directly. In addition, the PTC resistor of FIGS. 1 to 4 can be used in a three-phase system when all three connections are separately occupied. The examples of FIGS. 5 to 9 offer additional possibilities of application by reason of the fourth connection 29, namely in a single, two as well as three-phase system, the fourth connection 29 being employed for connection to a zero conductor in the two or three-phase system or for forming different PTC resistors in two-terminal construction in a single-phase system. Thus, when using this PTC resistor as a two-terminal network, five two-terminal networks with different resistance-temperature curves can be formed by the direct connection of two or more connections or leaving one or more connections unoccupied.

The application of the connections 21 to 23 at the peripheral edge 28 gives a more uniform current distribution in the resistor body than at the end face 24. Bonding over a comparatively large area has the advantage that, with different current supplies over the individual connections and consequently different heating of the individual regions of the resistor body, there is more rapid temperature and resistance balancing between these regions.

In a multi-phase system, the PTC resistor thus constitutes a load which automatically becomes symmetric.

Figure 10:
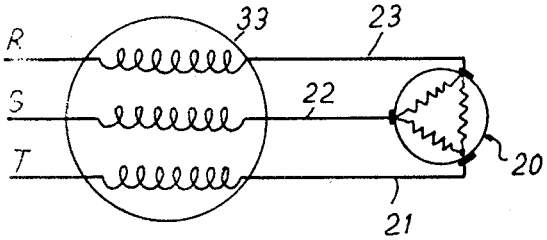
FIG. 10 shows the arrangement of the PTC resistor according to the invention at the star point of a three-phase load.

FIG. 10 shows an example of using a PTC resistor according to FIGS. 1 to 9 as a thermal fuse for a three-phase load 33, for example a generator, motor or transformer, the equivalent circuit diagram of the PTC resistor being represented as a delta circuit of ohmic resistances. The resistor body 20 is thermally connected to at least one of the windings or to a part influenced by the temperature of the windings of the load 33. As long as the temperature is under an upper limiting value, the PTC resistor is comparatively low ohmic so that the normal load current can flow. However, when the temperature exceeds the limiting value, the PTC resistor becomes high ohmic so that it limits the current to a few milliamps. After the load 33 is disconnected from the mains either manually or automatically in response to the voltage at the PTC resistor, and after cooling of the PTC resistor, the load can be connected again. In the case of a coil shortcircuit in one phase, the PTC resistor likewise limits the phase current, switching off again being possible automatically.

Figure 11:
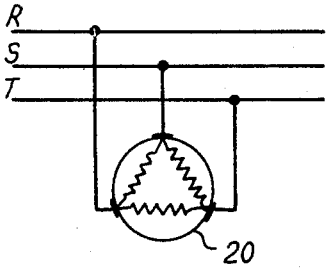
FIG. 11 shows the arrangement of a PTC resistor according to the invention at a three-phase mains.

FIG. 11 shows the use of a PTC resistor according to FIGS. 1 to 9 as a heating element energized from a three-phase mains. In this arrangement, the PTC resistor has the advantage of ensuring stabilization of the heating temperature even if the mains are asymmetrically loaded by other loads and the individual phase voltages are thereby different. A voltage increase even in only one phase would, by way of a current and temperature increases, lead to an increase in the resistance of the PTC resistor and thus again to a reduction in the current and temperature.

Figure 12:
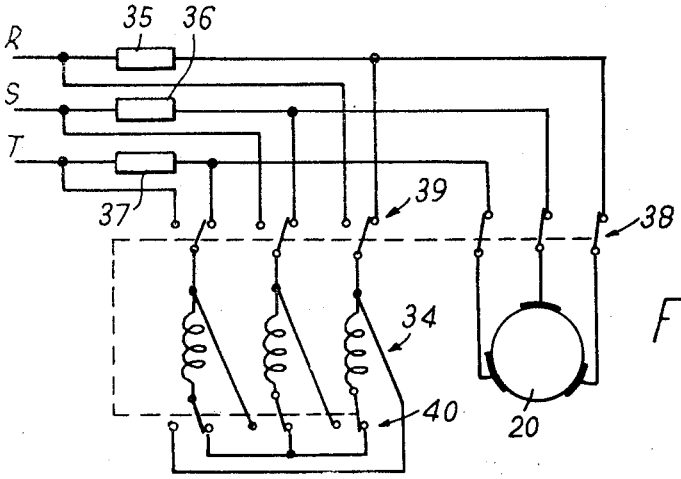
FIG. 12 shows the arrangement of a PTC resistor according to the invention for starting a three-phase A.C. motor.

In the arrangement of FIG. 12, a PTC resistor according to one of FIGS. 1 to 9 serves to start a three-phase A.C. motor 34. In the leads for the motor 34, there are three like starting series resistors 35, 36 and 37 and the PTC resistor is in shunt with the motor 34. Between the starting series resistors 35 to 37 there is a three-phase separating switch 38. In addition, the motor 34 is preceded by a three-phase reversing switch 39 which permits the motor 34 to be connected behind the starting series resistors 35 to 37. A further three-phase reversing switch 40 serves to switch the motor coils over from star to delta connection after starting. All the switches 38 to 40 can be actuated in unison or simultaneously as is indicated by the broken lines. In the illustrated position of the switch contacts, the motor 34 is started. The PTC resistor first has a low resistance so that the phase voltage applied to the motor 34 is comparatively low on account of this voltage distribution arrangement of the starting series resistors 35 to 37 and the PTC resistor body 20, whereby to limit the starting current of the motor 34. With an increase in the speed of the motor 34, its counter-EMF increases so that its operating voltage may also increase. This occurs automatically through the increase in the resistance of the PTC resistor body 20. A further increase can be effected by switching over the windings of the motor 34 from star to delta connection by means of the reversing switch 40 and by the simultaneous direct connection to the mains R, S, T by means of the reversing switch 39 when the motor has started. Simultaneously, the voltage divider formed by the starting series resistors 35 to 37 and the PTC resistor is disconnected from the mains by the separating switch 38 to avoid unnecessary power consumption during operation.

Compared with the use of a separate PTC resistor for each phase, in all cases of multi-phase use of the PTC resistor one eliminates the wiring of several connections and the difficulty of making or selecting PTC resistors having the same characteristic curve. Slight asymmetry in the production of the PTC resistor, whether in respect of the homogeneity or the distribution of the temperature-dependent material or with regard to the application of the connections, is automatically balanced out again by way of the temperature balancing.

The construction and use of the PTC resistor are not restricted to the illustrated examples. Thus, the number of connections may also be increased for connection to desired multi-phase systems having a higher phase number. The form of the resistor body can exhibit desired other rotationally symmetrical shapes, for example the shape of a sphere, a cylinder, a cone, a triangle, a tetrahedron or other regular polygons.

What is claimed is:

1. A resistor having a resistance which varies with temperature, comprising, a body of a substantially honogeneous cold conductor material, three connector pads bonded to said body at positions spaced from each other, said pads being of equal size and shape relative to each other, and each said pad being equally spaced from the other two of said pads.

2. A resistor according to claim 1 wherein said body has a rotationally symmetrical shape.

3. A resistor according to claim 2 wherein said body is disk shaped with first and second end surfaces connected by an outer cylindrical surface.

4. A resistor according to claim 3 wherein said three pads are on one of said end surfaces.

5. A resistor according to claim 3 wherein said three pads are on said cylindrical surface.

6. A resistor according to claim 4 including a fourth connector pad centrally located on the other of said end surfaces.

7. A resistor according to claim 3 wherein said body has a central cylindrically shaped bore, and a fourth pad having a cylindrical shape mounted in said bore.

* * * * *